United States Patent [19]

Messinger

[11] Patent Number: 4,526,250

[45] **Date of Patent: * Jul. 2, 1985**

[54] SPACE DIVIDERS AND METHOD OF MANUFACTURE

[76] Inventor: Alexander Messinger, 3725 Lankenau Rd., Philadelphia, Pa. 19131

[ * ] Notice: The portion of the term of this patent subsequent to Oct. 28, 1997 has been disclaimed.

[21] Appl. No.: 531,765

[22] Filed: Sep. 13, 1983

Related U.S. Application Data

[60] Division of Ser. No. 201,598, Oct. 28, 1980, Pat. No. 4,403,677, and a continuation-in-part of Ser. No. 4,438, Jan. 18, 1979, Pat. No. 4,230,365.

[51] Int. Cl.[3] ..... E04B 1/82

[52] U.S. Cl. ..... 181/295; 181/290; 181/296

[58] Field of Search ..... 181/30, 287, 291, 286, 181/293, 295, 296, 175, 198, 284, 290; 297/457, DIG. 1, DIG. 2; 52/309.1, 309.13, 239.63, 406; 427/389.8

[56] References Cited

U.S. PATENT DOCUMENTS

| | | | |
|---|---|---|---|
| D. 174,496 | 4/1955 | Freedman | 297/457 X |
| 2,865,436 | 12/1958 | Thorne | 297/218 X |
| 3,600,035 | 8/1971 | Vondrets | 297/457 X |
| 3,713,474 | 1/1973 | Orlando | 181/30 X |
| 3,999,802 | 12/1976 | Powers | 297/218 X |
| 4,040,212 | 8/1977 | Goransson | 181/287 X |
| 4,146,999 | 4/1979 | Petrovec et al. | 181/291 X |
| 4,276,954 | 7/1981 | Romano | 181/291 X |

*Primary Examiner*—L. T. Hix
*Assistant Examiner*—Brian W. Brown
*Attorney, Agent, or Firm*—Steele, Gould & Fried

[57] ABSTRACT

A space divider and method for making same, the space divider comprising a peripheral frame, having at least two portions lying in different planes and a fabric sleeve stretched over and entirely covering the peripheral frame, forming at least two double-curvilinear surfaces. The peripheral frame may comprise side rail members and a plurality of braces connecting the rail members. The fabric sleeve may be impregnated with a resinous material, thereby providing a substantially rigid omni-directional sound reflecting and dispersing surface, or left soft, with fill or padding optionally disposed between opposite surfaces of the fabric sleeve, thereby providing a omni-directional sound absorbing surface. The fabric sleeve may be a one-piece, two-way stretch member, such as different types of knitted materials or a non-stretch member of different types of woven materials. The space dividers are easily shaped in keeping with the requirements of space and sound control by stretching the fabric over a designed contour, thereby providing an inexpensive means for producing customized articles on a large scale. The space divider can also be filled with a thermal mass for temperature control.

3 Claims, 6 Drawing Figures

SPACE DIVIDERS AND METHOD OF MANUFACTURE

CROSS REFERENCES

This is a division of copending application Ser. No. 201,598, filed Oct. 28, 1980, now U.S. Pat. No. 4,403,677 granted Sept. 13, 1983. Application Ser. No. 201,598 is a Continuation-In-Part of co-pending Application Ser. No. 4,438, filed Jan. 18, 1979, now U.S. Pat. No. 4,230,365, issued Oct. 28, 1980. The subject matter of U.S. Pat. No. 4,230,365 is incorporated herein by reference in its entirety.

BACKGROUND OF THE INVENTION

1. Field of the Invention

This invention relates to the field of space dividers and methods of manufacturing space dividers. In particular, this invention relates to a simplified method of inexpensively producing customized contoured space dividers, which are both eminently practical for sound control and striking in appearance.

2. Descripton of the Prior Art

Heretofore, the known methods for producing customized contoured articles of furniture, including space dividers, which in a restricted sense are also termed room dividers, have been no different than producing generalized contoured furniture, except that the dimensions of the particular articles of furniture are suited to the dimensions of a particular individual or application. In conventional furniture, this requires frames, springs or webbing, and thickly padded cushions. In what is commonly referred to as more contemporary furniture, construction still involves frames, perhaps webbing, and often preformed cushioned members. Another contemporary alternative is the use of molded plastic material to form seat and/or back of a chair. These articles of furniture require the utilization of very expensive dies, heavy molding equipment and often costly raw materials. Further, additional pillows are a necessity unless the furniture is very precisely contoured.

Another kind of furniture, which in some aspects bears a superficial resemblance to this invention, is commonly called patio furniture. Such furniture usually comprises a tubular foldable frame which is covered by plastic webbing or pieces of fabric or canvas, which are drawn over different parts of the tubular frame.

Typical room dividers or partitions are usually rigid members, built like doors. They may be fabric covered, but the fabric merely covers or decorates an underlying structural panel. Where dividers are other than flat panels, they exhibit only simple curves or single-curvilinear surfaces.

This invention provides a method of manufacture by which customized contoured space dividers, or for that matter, furniture of general contours, may be easily and inexpensively produced. The various embodiments which may be incorporated into the method of manufacture permit such space dividers and furniture to be made for indoor as well as outdoor use, and in addition to the advantages noted herein, yields an article which is strikingly attractive.

SUMMARY OF THE INVENTION

It is an object of this invention to provide a space divider which is distinctively styled and which controls sound within the defined space.

It is a further object of this invention to provide a space divider which controls sound omni-directionally.

It is another object of this invention to provide a sound controlling space divider which is relatively inexpensive to manufacture and suitable for use in virtually any environment.

It is yet a further object of this invention to provide a space divider which omni-direction sound dispersing and absorbing characteristics.

It is yet another object of this invention to provide a method for manufacturing a space divider having at least two double-curvilinear surfaces.

It is yet another object in this invention to provide a method for manufacturing a space divider as described.

Briefly, and in accordance with the foregoing objects, this invention provides a space divider, in some applications serving as a room divider, and a method for manufacturing same. A space divider according to this invention comprises a peripheral frame, having at least two portions lying in different planes, and a fabric sleeve stretched over and entirely covering the peripheral frame, forming at least two double-curvilinear surfaces. The peripheral frame may comprise side rail members and a plurality of braces connecting the rail members, the braces being disposed so as not to interfere with the self-shaping characteristics of the fabric sleeve. The contours of the space divider are easily controlled by the shape and dimensions of the side rail members, rendering an article of customized design no more difficult or expensive to manufacture than an article of general contour. The fabric sleeve may be impregnated with a resinous material, thereby providing a substantially rigid omni-directional sound reflecting and dispering. If the fabric is left soft, it provides an omni-directional sound absorbing surface. Padding may be disposed between the fabric sleeve and the peripheral frame, enhancing the sound absorbancy. In the case where the fabric sleeve is impregnated with a resinous material, it may be desirable to cover the space divider with a fabric sleeve made from a softer material. A space divider with a resin impregnated material would make an ideal structure for ceiling or outdoor use. In the case where the fabric is not treated with resin, the sleeve can be removed for easy cleaning or changed to provide diversity of color. A resin treated sleeve may also be covered with a removable untreated sleeve. Such removable sleeves may be connected by releasable fasteners, such as zippers or VELCRO strips.

The method of manufacturing furniture according to this invention comprises the steps of forming side rail members, in the desired contour, and a plurality of cross braces into a peripheral frame, having at least two portions lying in different planes, and drawing a fabric sleeve, preferably made from a two-way stretch material, over the peripheral frame, thereby forming at least two double-curvilinear surfaces. Various embodiments of a space divider according to this invention may be formed by impregnating a fabric sleeve with a resin material after it has been drawn over the peripheral frame, or by securing padding in appropriate places on the peripheral frame prior to drawing the fabric over the peripheral frame. The methods of this invention are applicable to articles of almost any general contour, or which the double-curvilinear surfaces may be produced.

Space dividers according to this invention may also be filled with a thermal mass material, such as water, for use in passive solar heating systems. The resin impregnated fabric can form a fluid tight container, which can be provided with valves for filling and draining the water.

BRIEF DESCRIPTION OF THE DRAWINGS

For the purposes of illustrating this invention, there are shown in the drawings forms which are presently preferred; it being understood, however, that this invention is not limited to the precise arrangements and instrumentalities shown.

DETAILED DESCRIPTION OF THE PREFERRED EMBODIMENT

Figure 1:
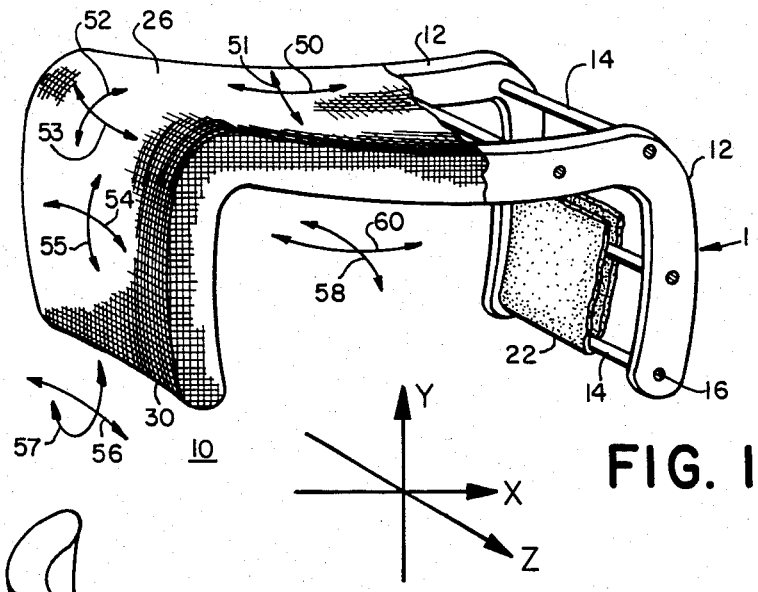
FIG. 1 is a perspective view of a space divider, with the fabric cover partially broken away, in order to show the peripheral frame.

Space dividers of various contours are shown in the figures. FIG. 1 is a space divider 10, which depending upon scale, may be an independent structure or a module of a larger structure. In form, it is identical to the ottoman or foot rest shown in FIG. 6 of my co-pending Application, now U.S. Pat. No. 4,230,365. Space dividers may be constructed in the manner taught therein, and accordingly, the teachings of U.S. Pat. No. 4,230,365 are fully incorporated herein by reference. Inherent in each of the articles of furniture shown therein are at least two double-curvilinear surfaces formed by a fabric sleeve stretched over, and entirely covering a preipheral frame, the frame having at least two portions lying in different planes.

With reference to FIGS. 1–5 of U.S. Pat. No. 4,230,365 and FIG. 1 herein, there are two side rail members 12 which in this case are substantially identical. The shape of side rail members 12 determines the overall contour of the space divider, and accordingly, is the basis for providing customized articles at relatively inexpensive cost. The side rail members 12 are joined by a plurality of braces 14. The braces 14 and side rail members 12 are conveniently connected by attachment means 16. The rail frame members 12 and connected braces 14 together form a peripheral frame 18. It has been found that suitable side rail members may be formed from $\frac{3}{4}''$ thick plywood stock, the rails being approximately 4" wide. The braces 14 may be formed from 1" diameter wooden dowels, which are attached by $1\frac{1}{2}''$ long wood screws. Tubular metal elements may also be utilized. Attachment of the dowels may be facilitated by boring through holes in the side rail members and pilot bore holes in the wooden dowels prior to attachment. The attachment means 16 should be flush with the outer surfaces of the side rail members. In the case of wood screws, it would be necessary to provide countersunk holes for the heads of the wood screws. Construction of the peripheral frame 18, in the desired contour, constitutes the first step in the method of constructing a space divider according to this invention.

The next step in the construction, which is optional, and utilized in the construction of sound absorbing space dividers, is to attach a rubber or foam padding 22 to the braces 14. The padding may be glued, stapled or tacked, in accordance with standard upholstery procedures. As noted, in certain embodiments it is desirable to omit the padding 22 entirely, for example, where the fabric sleeve is resin treated to form a sound reflecting or dispersing space divider.

A fabric sleeve 26, which may be formed from a two-way stretch fabric, such as different types of knitted materials, and which has been formed or knitted into a long sleeve or sock is stretched over the frame so as to entirely cover the frame. The sleeve may also be a non-stretch member of different types of woven materials.

Where a removable sleeve is desired, a closing seam 30 may comprise releasable fastening means such as a zipper or VELCRO fastening strips. Where the fabric is to be resin treated, the seam may be sewn or glued.

In order to construct a space divider or an article of furniture such as the foot rest or ottoman shown in FIG. 1 herein, it should be apparent that it is unnecessary to form breaks or openings in the peripheral frame, as with other articles of furniture, because the frame is not continuous.

In FIG. 1, pairs of arrows are used to indicate the plurality of double-curvilinear surfaces. A three dimensional reference axis is provided to assist in proper interpretation of the arrows. For purposes of this description, any arrow lying in a reference plane (x-y, x-z, y-z) or in a plane parallel to a reference plane, is considered to lie in that reference plane. For example, arrow 50 lies in an x-y plane whereas arrow 51 lies in a y-z plane. The fabric curves in two directions simultaneously, hence the description of a double-curvilinear surface. If the fabric is permitted to reach an equilibrium state stretched between the peripheral frame, it will tend toward formation of a minimal surface area configuration. A common minimal surface area configuration is a saddle. With the foregoing as a reference, arrow 52 is in an x-y plane and arrow 53 is in a plane running at 45° through the z axis, between the -x and y axes and the x and -y axes. Arrow 54 is in an x-z plane and arrow 55 is in an x-y plane. Arrow 56 is in a y-z plane and arrow 57 is in an x-y plane. Arrow 58 is in a y-z plane and arrow 60 is in an x-y plane. Accordingly, a space divider according to this invention has at least two, and more often a plurality of double-curvilinear surfaces.

In addition to the various contours into which space dividers may be manufactured, it is also contemplated to provide both rigid and soft sound controlling surfaces.

Due to the double-curvilinear surface configuration, each space divider will have portions of its surface facing in all or nearly all directions. It will present an omni-directional sound receiving surface. If the fabric is rigidified, for example impregnated with a resinous material such as polyester or epoxy resin, the space divider will reflect sound waves, enhancing echo effects. If the fabric is not made rigid, it will tend to absorb sound waves, reducing echo effects. Sound absorbing may be enhanced by fillers, such as padding or foam disposed behind the fabric sleeve surface. When fillers are used, care must be taken that the filler material does not come in contact with the fabric, as it will distort the natural tendancy toward the minimal surface area equilibrium condition. In a sense, such space dividers can be calibrated as to the level of sound absorption or reflection. Where space dividers are constructed from modules, for example, some may be made rigid and others not. Further, in a larger space divider, or even with each module, only portions of each surface may be made rigid. By definition, a space divider creates at least two spaces where only one space existed previously. One of the new spaces may be provided with a sound absorbing surface and the other new space may be provided with a sound reflecting surface.

Figure 2:
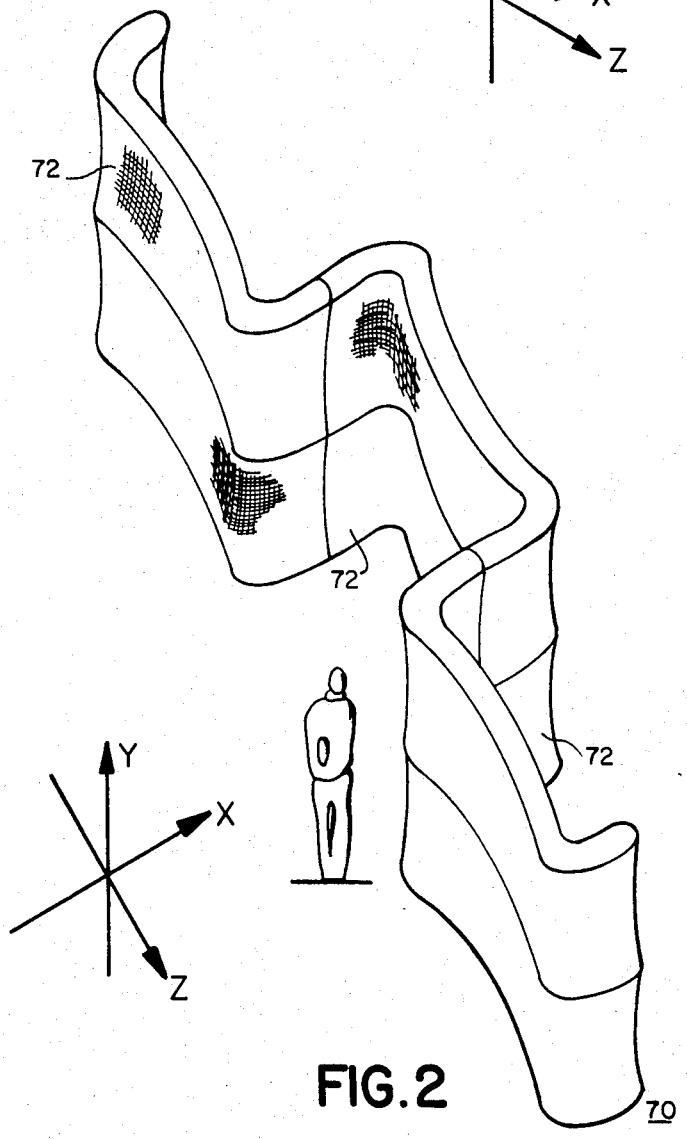
FIG. 2 is a perspective view of several space dividers as shown in FIG. 1, used as modules to form a larger structure.

A modular space divider 70 oriented as a room divider, is shown in FIG. 2. Each of the modules 72 is similar in shape and construction to the space divider of FIG. 1, which is itself similar to the ottoman or foot rest of U.S. Pat. No. 4,230,365. The modules can be attached by any suitable bracket arrangement. In an office setting, for example, the use of releasable brackets would be advantageous.

Figure 3:
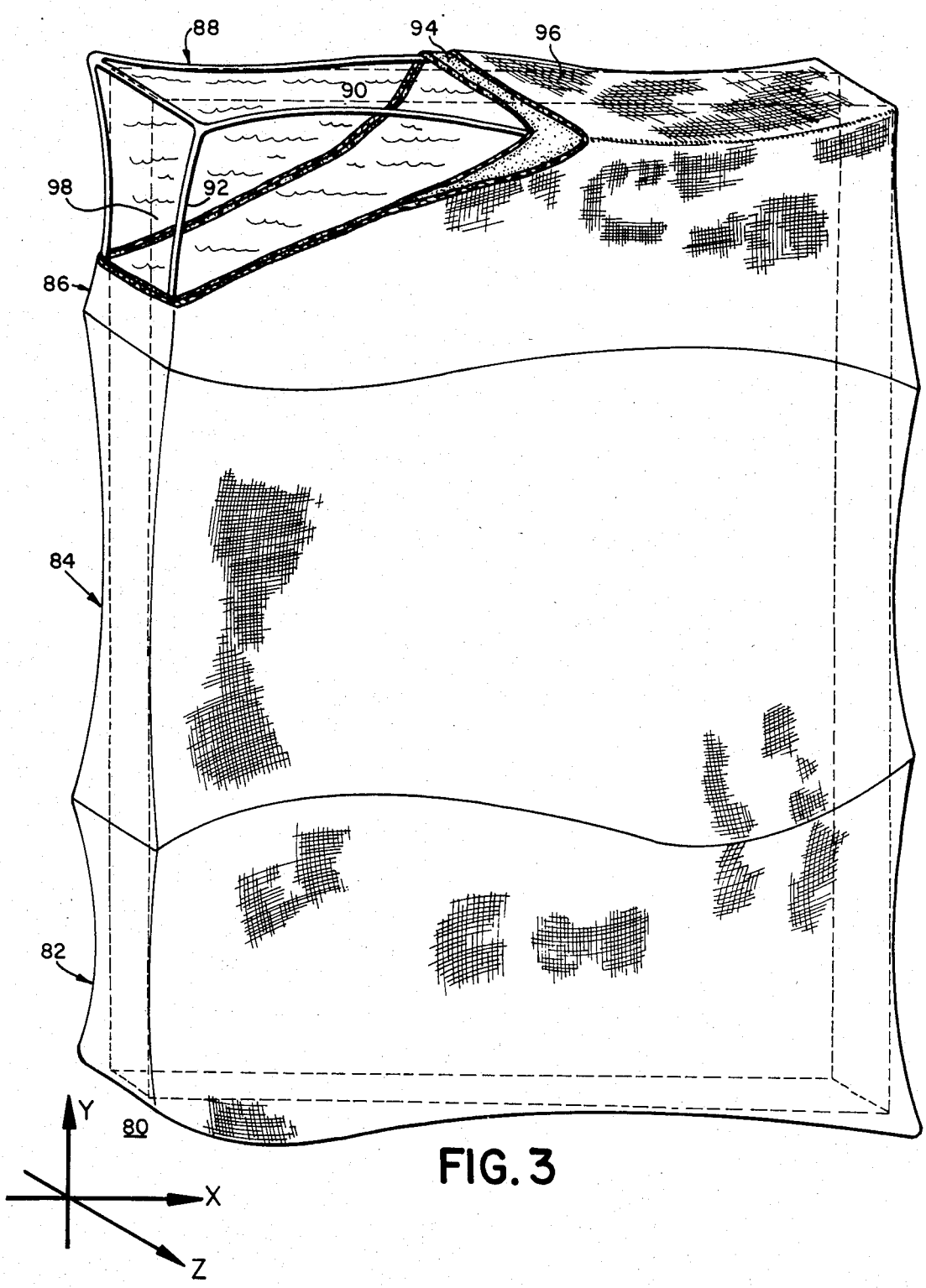
FIG. 3 is a perspective view of another space divider, with the fabric cover partially broken away.

The space divider 80 shown in FIG. 3 comprises three modules 82, 84 and 86, although it could be formed as an integral unit. The peripheral frame 88 comprises tubular metal members bent to shape and secured in a lattice formation. An inner rectangular block is shown in dotted lines, for purposes of better illustrating the curvature of the peripheral frame members. Each module, one of which is partially uncovered, has an inner fabric sleeve or tube stretched thereover, the fabric forming at least two double-curvilinear surfaces. The fabric sleeve 94 is resin impregnated. An outer fabric sleeve 96 covers the rigidified sleeve 94 to present a more appealing and pleasantly textured surface. A soft outer sleeve also absorbs sound. The double-curvilinear surfaces result from at least two portions of the peripheral frame lying in different planes. With respect to an x, y, z reference axis, for example, frame member 90 lies in an x-z plane and frame member 92 lies in a y-z plane. It may be appreciated that if both frame members 90 and 92 were straight they would lie in the same plane. The fact that at least one is itself non-linear assures that a double-curvilinear surface will result. The fact that the peripheral frame has a non-negligable thickness assures that at least two double-curvilinear surfaces will be formed. Each module is filled with a thermal mass 98, such as water, forming a passive heat collector. The fabric may be painted or colored resins may be utilized in this and other embodiments.

Figure 4:
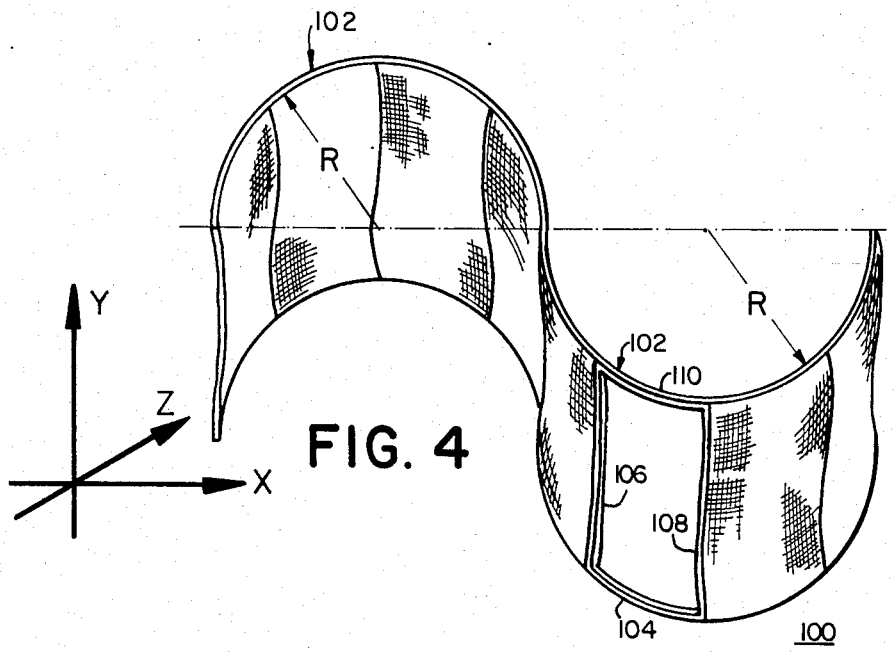
FIG. 4 is a perspective view of a plurality of modular space dividers of yet another configuration forming a room divider, over which the fabric sleeve has been entirely drawn.

In FIG. 4, a free-standing room divider 100 comprises a plurality of space divider modules 102. Each module 102 has an overall radius of curvature R. Superimposed in this single curvilinear configuration are the double-curvilinear surfaces of this invention. Each module comprises a lower frame member 104, side frame members 106 and 108, and an upper frame member 110. The upper and lower frame members are parallel and have simple curves in accordance with the radius R. Frame members 104 and 110 each lie in a horizontal (x-z) plane. Side frame members 106 and 108 are each shaped like a gentle "S", each lies in a vertical (y-z) plane, and they are parallel, although the gentle "S" curves could be oppositely directed.

Figure 5:
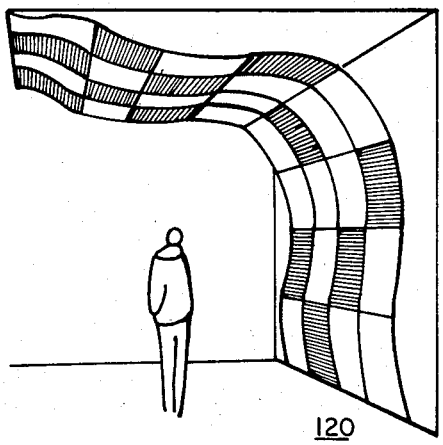
FIG. 5 is a perspective view of a plurality of modular space dividers of still another configuration forming wall and ceiling structure or a covering therefor; and, FIG. 6 is a perspective view of one of the space divider modules of FIG. 4, illustrating omni-directional sound and energy control.

Modules similar to those shown in FIG. 4 are utilized to form a wall and ceiling structure 120 as shown in FIG. 5. Articles according to this invention define spaces, not necessarily rooms. A space divider is not necessarily a room divider.

It should be understood that the use of many other materials and securing means for the peripheral frame are contemplated by this invention. The materials may comprise metals such as aluminum or steel, and the securing means may include pin and dowel arrangements, rivets, brackets and the like. Other fabrics may also be suitable for use in practicing this invention, as well as other padding materials.

Where a fabric sleeve is to be resin impregnated the peripheral frame will require fewer internal braces, as the finished structure will become integrated and unitary, that is the fabric sleeve also serves as a functional load bearing component.

Figure 6:
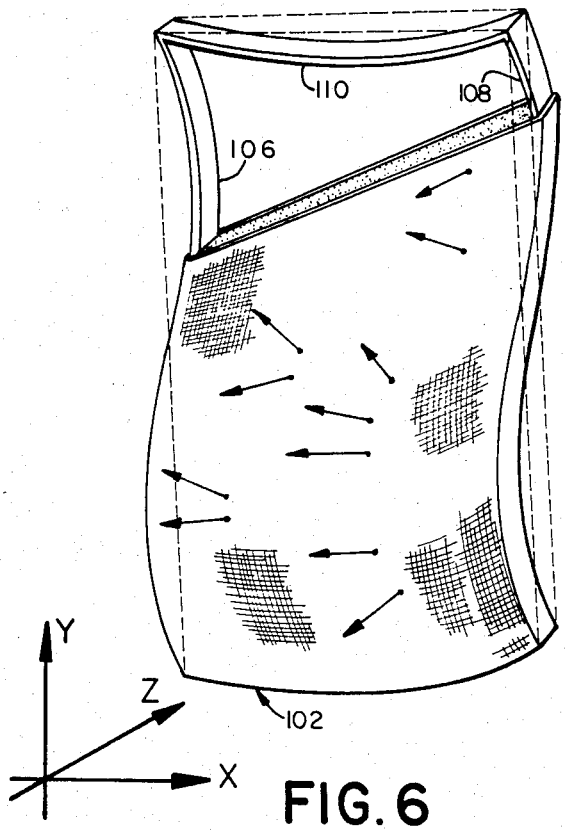

FIG. 6 illustrates an enlarged view of one of the modules shown in FIG. 4. The arrows indicate a sampling of lines normal to the double-curvilinear surface. These lines show how both sound and radiant energy can be absorbed or reflected in so many directions as to be considered omni-directional. In a module such as 102, which has an overall simple curvilinear configuration, the convex side would be an ideal solar energy collecting surface and the concave side would be an ideal surface for focusing radiating energy within a living or working space.

The present invention may be embodied in other specific forms without departing from the spirit or essential attributes thereof, and accordingly, reference should be made to the appended claims, rather than the foregoing Specification as indicating the scope of the invention.

I claim:

1. A modular assembly, comprising:

at least two peripheral frame members, each having at least two arcuate portions;

a soft, stretchable fabric sleeve stretched over and entirely covering the peripheral frame members, the fabric resiliently forming itself into at least two major omni-directional double-curvilinear surfaces in a natural equilibrium condition; and, the fabric sleeve being impregnated with a resinous material, thereby forming an integral, substantially rigid modular assembly together with the frame members.

2. A modular assembly formed from at least two modules, each of the modules comprising:

at least two peripheral frame members, each having at least two arcuate portions;

a soft, stretchable fabric sleeve stretched over and entirely covering the peripheral frame members, the fabric resiliently forming itself into at least two major omni-directional double-curvilinear surfaces in a natural equilibrium condition; and, the fabric sleeve being impregnated with a resinous material, thereby forming an integral, substantially rigid modular assembly together with the frame members.

3. A method for constructing a modular assembly, comprising the steps of:

forming at least two peripheral frame members, each having at least two arcuate portions;

stretching a soft, stretchable fabric sleeve over the frame members entirely covering the frame members, the fabric forming itself into a natural equilibrium configuration which creates at least two omni-directional double-curvilinear surfaces; and, impregnating the fabric sleeve with a resinous material, thereby forming an integral, substantially rigid modular assembly together with the frame members.

* * * * *